United States Patent [19]

Fujimura et al.

[11] Patent Number: 4,533,232

[45] Date of Patent: Aug. 6, 1985

[54] ELECTROPHOTOGRAPHIC PROCESS

[75] Inventors: Naoto Fujimura, Yokohama; Akihiro Sonobe, Tokyo; Toshiyuki Yoshihara, Mitaka; Norie Takebayashi, Tokyo; Takashi Tanaka, Kawasaki; Masaki Kuribayashi, Higashi Kurume, all of Japan

[73] Assignee: Canon Kabushiki Kaisha, Tokyo, Japan

[21] Appl. No.: 474,178

[22] Filed: Mar. 10, 1983

[30] Foreign Application Priority Data

Mar. 18, 1982 [JP] Japan ..... 57-43836

[51] Int. Cl.[3] ..... G03G 15/00

[52] U.S. Cl. ..... 355/3 R; 355/3 CH; 355/14 CH; 355/14 E; 430/60; 430/62

[58] Field of Search ..... 355/3 CH, 3 DR, 3 R, 355/14 E, 14 CH, 4; 430/60, 61, 62, 48, 54, 126

[56] References Cited

U.S. PATENT DOCUMENTS 3,649,261 3/1972 Dahlquist et al. ..... 430/57 X 3,707,138 12/1972 Cartwright ..... 430/126 X 4,168,164 9/1979 Furuya et al. ..... 355/4 X 4,359,514 11/1982 Shimizu et al. ..... 355/3 DR X

*Primary Examiner*—A. C. Prescott

*Attorney, Agent, or Firm*—Fitzpatrick, Cella, Harper & Scinto

[57] ABSTRACT

An electrophotographic process comprising the steps of:

(a) charging an electrophotographic photosensitive member comprising a conductive substrate and a photosensitive layer which includes a charge generation layer and a charge transport layer containing a charge-transporting material;

(b) forming an image on the charged electrophotographic photosensitive member by exposing the charged photosensitive member to light substantially free of rays having the wavelength band which can be absorbed by the charge-transporting material contained in the charge transport layer; and (c) developing the image with a developer.

47 Claims, 3 Drawing Figures

ELECTROPHOTOGRAPHIC PROCESS

BACKGROUND OF THE INVENTION

1. Field of the Invention

This invention relates to an image forming process employing an electrophotographic photosensitive member, and more particularly to an image forming process to effectively maintain the light area potential of the photosensitive member at a substantially constant value during repeated operations thereof.

2. Description of the Prior Art

Selenium, cadmium sulfide, zinc oxide, etc. have so far been known as inorganic photoconductive materials for use in electrophotographic photosensitive members. On the other hand, organic photoconductive materials have been proposed including a variety of photoconductive polymers, the first of the polymers being polyvinylcarbazole, and a number of low-molecular photoconductive substances such as hydrazones, pyrazoline compounds, oxadiazole compounds, indole compounds, carbazole compounds, anthracene, and pyrene.

Organic photoconductive materials are generally superior to inorganic photoconductive materials in light weight, coating-ability, etc. However, since their sensitivity is insufficient, various methods have been offered for sensitizing them. An effective one of such methods is to improve the sensitivity by allotting the functions of a photosensitive member to two contiguous layers, one generating charge carriers on light irradiation and the other transporting these charge carriers, as disclosed, for example, in U.S. Pat. Nos. 3,837,851 and 3,871,882.

It is necessary in this separate-function type of photosensitive layer that the charge carriers injected into the charge transport layer from the charge generation layer are transported to the neighborhood of the surface of the charge transport layer in an electric field without being trapped in the course of the transport layer. In practice, however, a number of repetitions of charging and exposing this type of photosensitive member raise the light area potential, which is conceivably caused by the accumulation of the trapped carriers.

According to studies of the present inventors, a charge transporting material contained in the charge transport layer undergoes an irreversible reaction, particularly in the vicinity of the surface, by absorbing ultraviolet or visible light; presumably, the irreversible reaction product may trap and accumulate charge carriers injected from the charge generation layer; thus the light portion potential gradually increases on repeated use of the photosensitive member.

Such phenomenon can be observed when the photosensitive layer is exposed to an environment including, for example, ultraviolet rays. In practice, when the photosensitive member is placed under exposure to external light including ultraviolet rays even for an instant, before being assembled in a copying machine and when thereafter it is mounted in the copying machine to be subjected to the usual image forming process including repetitive charging and exposing, the light area potential tends to gradually to result in images with considerable fogging.

SUMMARY OF THE INVENTION

An object of this invention is to provide an image forming process and apparatus employing the laminate (separate-function) type of electrophotographic photosensitive member, from which the foregoing drawbacks are eliminated.

Another object of this invention is to provide an image forming process and apparatus employing the laminate type of electrophotographic photosensitive member, wherein the irreversible reaction, that may be caused in the charge transport layer by ultraviolet or visible light incident on this layer, in inhibited.

A further object of this invention is to provide an image forming process and apparatus capable of preventing an increase in the light area potential during repeated use of the photosensitive member.

The objects of this invention can be achieved with an electrophotographic process comprising the steps of; (a) charging an electrophotographic photosensitive member comprising a conductive substrate and a photosensitive layer which comprises a charge generation layer and a charge transport layer; (b) exposing the charged photosensitive member to a light substantially free from rays having the wavelength band which can be absorbed by the charge-transporting material contained in said charge transport layer; and (c) developing with a developer.

DETAILED DESCRIPTION OF THE INVENTION

This invention is characterized in that the light incident on the charge transport layer during the image forming process, in particular during the image exposure or charge-eliminating exposure, contains substantially no light of wavelengths that will be absorbed by the charge-transporting material which is present in the charge transport layer. That is to say, in image forming processes by use of an electrophotographic photosensitive member, light is used in the exposure steps for forming an electrostatic latent image and for eliminating static charge remaining in the photosensitive member after transferring of a toner image formed thereupon. This light contains the rays which will cause the irreversible reaction of the charge-transporting material. This invention has been accomplished through finding that the foregoing drawbacks can be eliminated by cutting these injurious rays with a filter.

In preferred embodiments of this invention, the cutting of the injurious rays can be accomplished by separately arranging filters in front of light sources for the image exposure and for the charge eliminating exposure or by setting a filter over the photosensitive member during these exposure steps.

Figure 1:
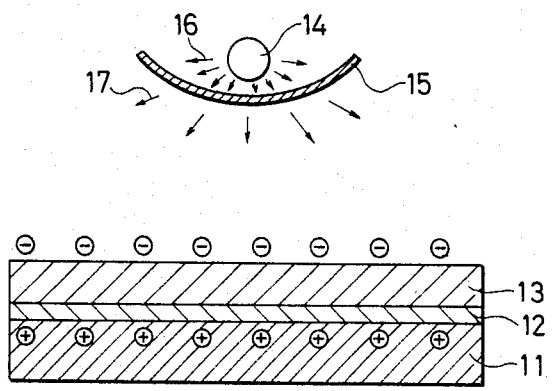
FIGS. 1 and 2 are diagrammatic sectional views illustrating an exposure step of the electrophotographic process of this invention.
Figure 2:
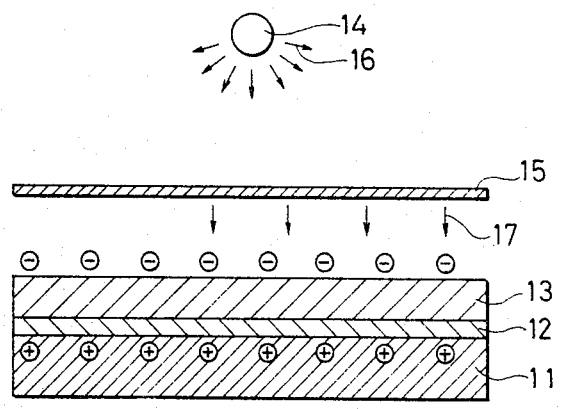

FIGS. 1 and 2 are illustrations for explaining preferred embodiments of the present image forming process.

FIG. 1 schematically illustrates an embodiment of forming an electrostatic latent image on a laminated photosensitive layer comprising a conductive substrate 11 and a photosensitive laminate thereupon composed of a charge generation layer 12 and a charge transport layer 13. The image forming process includes image exposure of the photosensitive layer after a corona discharge to give negative charge to the surface of the charge transport layer 13. In this case, a light beam 17 incident on the charge transport layer can be substantially free from the injurious rays by setting a filter 15 in front of the light source 14 (e.g. a halogen lamp, tungsten lamp, or xenon lamp) so as to filter the light beam 16 projected from the light source 14 to the photosensitive member (for instance, by covering the light source 14 with the filter 15 or setting the filter 15 near the light source 14). This means of light exposure is also adaptable to the charge-eliminating exposure.

FIG. 2, a modification of the embodiment shown in FIG. 1, illustrates an embodiment wherein a similar filter 15 as used in the embodiment shown in FIG. 1 is set in a position slightly apart from the surface of the charge transport layer. The filter 15 can also be placed on this surface (in FIG. 2, the same symbols as in FIG. 1 have the same meaning).

Although the charge transport layer 13 is on the top of the photosensitive member, the charge generation layer 12 can also be laid at the top.

The filter used in this invention is selected depending upon the light absorption characteristics of the charge-transporting material contained in the charge transport layer of the photosensitive member used. A filter is chosen that can eliminate the rays absorbable by the charge-transporting material.

Many charge-transporting materials generally used may absorb blue light and/or ultraviolet light. Accordingly, yellow filters or ultraviolet-absorbing filters are generally used. However, when the absorption spectrum of the charge-transporting material used is different from those of the above, it is of course necessary to choose a filter capable of cutting off the rays of wavelengths corresponding to the absorption spectrum.

The filter used is selected from commercial glass filters, gelatin filters, plastic filters, interference filters, colored cellophane, etc. so as to meet the light absorption characteristics of the charge-transporting material used. The filter can also be prepared by covering a transparent substrate with a dye having the necessary light-absorption characteristics or with the same charge-transporting material as used in the charge transport layer, in a way such as vapor deposition, dyeing, or coating; or by melt-mixing said dye or charge-transporting material with a resin or the like.

Figure 3:
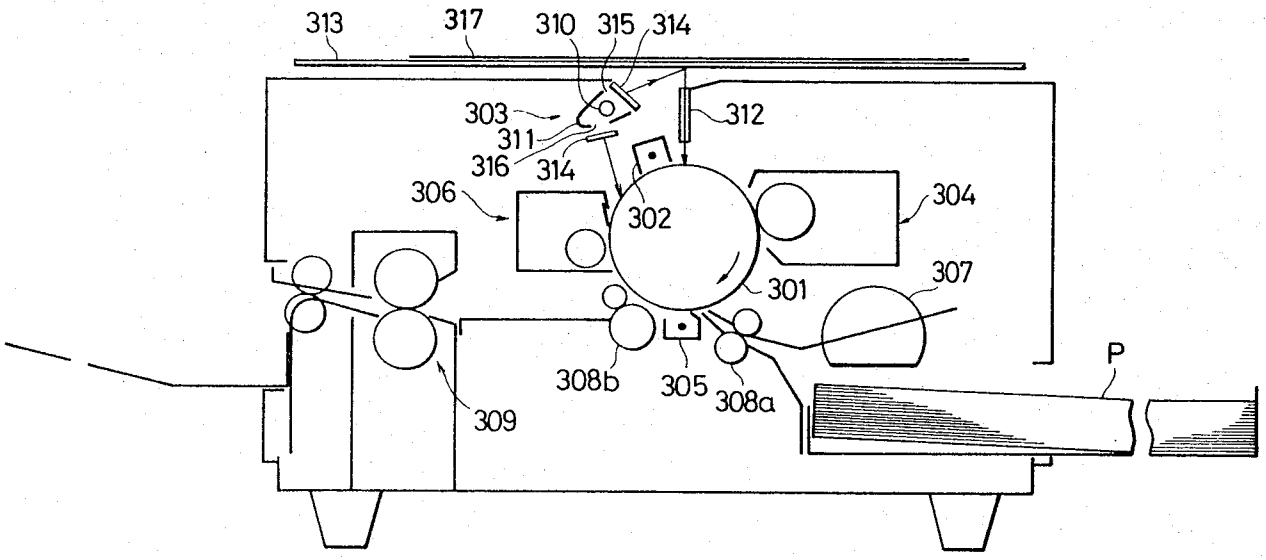
FIG. 3 is a sectional view of an electrophotographic copying machine showing an embodiment of the image forming apparatus of this invention.

FIG. 3 shows a sectional view of an electrophotographic copying machine as an embodiment of the image forming apparatus of this invention. In this drawing, 301 is an electrophotographic photosensitive member, which is surrounded serially in the direction of its rotation with a corona charger 302, exposure device 303, developing device 304, corona charger 305 for transferring, and cleaning device 306. A path for conveyance of recording paper P (a member to be transferred) is formed under the photosensitive member 301. Along the path, there are disposed, in sereis from the paper-feed side to the paper-discharge side, a recording-paper feeder 307, conveyers 308*a* and 308*b*, and a fixing device 309.

The corona charger 302, being for uniformly distributing electric charge to the surface of the photosensitive member 301, can provide negative charge when the charge transport layer of the photosensitive member 301 has a hole-transporting nature, and positive charge when the charge transport layer has an electron-transporting nature. This switch of charge can be performed by suitable means.

The exposure device 303 is comprised of an exposure light source (halogen lamp, xenon lamp, tungsten lamp, helium-cadmium laser, argon laser, semiconductor laser, etc.) 310, reflector 311, and convergent optical transmitter 312 as an imaging optical means. The reflector 311 is designed to direct the light beam, projected from the exposure light source 310, to a manuscript 317 placed on a reciprocating manuscript table 313 and to the photosensitive member 301 for eliminating charge after transferring a toner image onto recording paper. Across each of the optical paths, one or more ultraviolet-absorbing filters or yellow filters 314 are placed at openings 315 and 316 of the reflector 311 or in the front or back of the convergent optical transmitter 312, which transmits the light beam reflected from the manuscript 317.

For the developing device 304, various known types may be used, including the magnetic brush type, the jumping type, etc. The developing agent used in the developing device 304 is, for instance, a binary system comprising a carrier and a toner.

The corona charger 305 for transferring operates to give electric charge of a polarity, reverse to that of the toner, to the rear face of recording paper superposed on a toner image formed on the photosensitive member 301, thereby transferring the image to the paper.

The cleaning device 306 and the fixing device 309 also may be of various known types. For example, a blade type of cleaning device and a heat roll type of fixing device can be used, respectively.

The charge transport layer of the photosensitive member 301 can contain the following electron-transporting substances (electron attractive substances) or hole-transporting substances:

Chloranil, bromanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, 2,4,8-trinitrothioxanthone, and polymers of these compounds.

Hole-transporting substance:

Pyrene, N-ethylcarbazole, N-isopropylcarbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine; hydrazones such as p-diethylaminobenzaldehyde-N,N-diphenylhydrazone, p-diethylaminobenzaldehyde-N-α-naphthyl-N-phenylhydrazone, p-pyrrolidinylbenzaldehyde-N,N-diphenylhydrazone, 1,3,3-trimethylindolenene-ω-aldehyde-N,N-diphenylhydrazone, and p-diethylbenzaldehyde-3-methylbenzothiazolinone-2-hydrazone; pyrazolines such as 2,5-bis(p-diethylaminophenyl)-1,3,4-oxadiazole, 1-phenyl-3-(p-diethylaminostyryl)-5-(p-diethylaminophenyl)pyrazoline, 1-[quinolyl(2)]-3-(p-diethylaminostyryl)-5-(p-diethylaminophenyl)pyrazoline, 1-[pyridyl(2)]-3-(p-diethylaminostyryl)-5-(p-diethylaminophenyl)pyrazoline, 1-[6-methoxypyridyl(2)]-3-(p-diethylaminostyryl)-5-(p-diethylaminophenyl)-pyrazoline, 1-[pyridyl(3)]-3-(p-diethylaminostyryl)-5-(p-diethylaminophenyl)pyrazoline, 1-[lepidyl(2)]-3-(p-diethylaminostyryl)-5-(p-diethylaminophenyl)pyrazoline, 1-[pyridyl(2)]-3-(p-diethylaminostyryl)-4-methyl-5-(p-diethylaminophenyl)pyrazoline, 1-[pyridyl(2)]-3-(α-methyl-p-diethylaminostyryl)-5-(p-diethylaminophenyl)pyrazoline, 1-phenyl-3-(p-diethylaminostyryl)-4-methyl-5-(p-diethylaminophenyl)pyrazoline, 1-phenyl-3-(α-benzyl-p-diethylaminostyryl)-5-(p-diethylaminophenyl)pyrazoline, and spiropyrazoline; oxazole compounds such as 2-(p-diethylaminostyryl)-6-diethylaminobenzoxazole, and 2-(p-diethylaminophenyl)-4-(p-dimethylaminophenyl)-5-(2-chlorophenyl)oxazole; thiazole compounds such as 2-(p-diethylaminostyryl)-6-diethylaminobenzothiazole; triarylmethane compounds such as bis(4-diethylamino-2-methylphenyl)-phenylmethane; polyarylalkanes such as 1,1-bis(4-N,N-diethylamino-2-methylphenyl)-heptane and 1,1,2,2-tetrakis(4-N,N-dimethylamino-2-methylphenyl)ethane; triphenylamine; and polymers such as poly(N-vinylcarbazole), polyvinylpyrene, polyvinylanthracene, polyvinylacridine, poly(9-vinylphenylanthracene), pyreneformaldehyde resin, and ethylcarbazole-formaldehyde resin.

This invention is especially effective when using a charge-transporting material, like hydrazone compounds, having a high extinction coefficient for ultraviolet rays or blue light.

The charge transport layer can be formed by dissolving the foregoing charge-transporting substance and a binder resin in a suitable solvent, applying the resulting solution, and drying it.

The binder resins for use in the charge transport layer include polyarylate resins, polysulfone, polyamides, acrylic resins, polyacrylonitrile, methacrylic resins, vinyl chloride resin, vinyl acetate resin, phenolic resin, epoxy resins, polyesters, alkyd resin, polycarbonates, polyurethanes, and copolymers such as styrene-butadiene copolymer, styrene-acrylonitrile copolymer, and styrene-maleic acid copolymer. Besides these insulating polymers, organic photoconductive polymers can also be used, including polyvinylcarbazole, polyvinylanthracene, polyvinylpyrene, etc.

The charge transport layer cannot be made thicker than necessary because the maximum possible distance of charge-carrier transport is limited. The thickness is in the range generally of 5 to 30μ, preferably of 8 to 20μ. When the charge transport layer is formed by coating, various methods are applicable, including dip coating, spray coating, spinner coating, bead coating, Meyer bar coating, blade coating, roller coating, curtain coating, etc.

The charge transport layer in this invention may contain various additives; for example, diphenyl, o-terphenyl, p-terphenyl, dibutyl phthalate, dimethyl glycol phthalate, dioctyl phthalate, triphenyl phosphate, methylnaphthalene, benzophenone, chlorinated paraffin, dilauryl thiodipropionate, 3,5-dinitrosalycylic acid, and various kinds of fluorocarbons.

The charge generation layer of the electrophotographic photosensitive member 301 can be formed by vapor deposition or applying a dispersion in a resin, of a charge-generating material selected from selenium, selenium-tellulium, pyrylium dyes, thiopyrylium dyes, phthalocyanine pigments, anthoanthrone pigments, dibenzopyrenequinone pigments, pyranthrone pigments, trisazo pigments, disazo pigments, monoazo pigments, indigo pigments, quinacridone pigments, asymmetric quinocyanine, symmetric quinocyanine, and amorphous silicon, which is described in Japanese Patent Laid-Open No. 143645/1979.

The following are typical examples of the charge-generating material used in this invention:

(1) Amorphous silicon
(2) Selenium-tellulium
(3) Selenium-arsenic
(4) Cadmium sulfide (5)
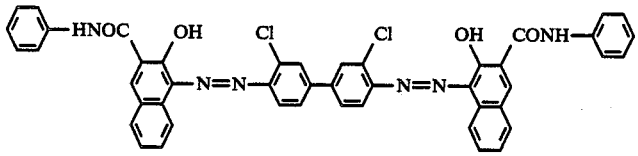

(6)
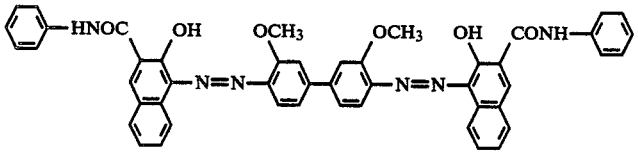

(7)
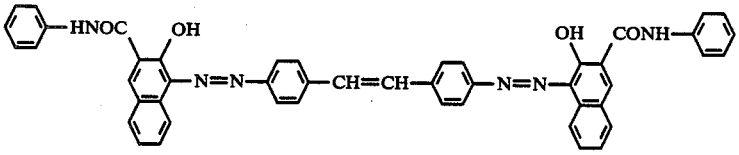

(8)
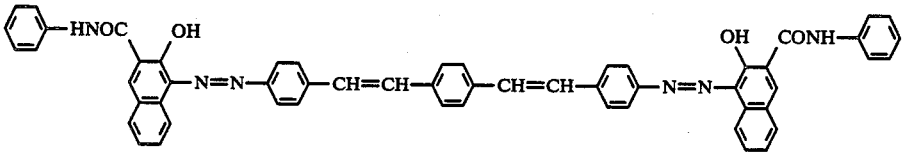

-continued
(9) 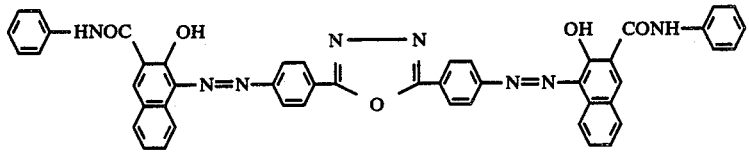
(10) 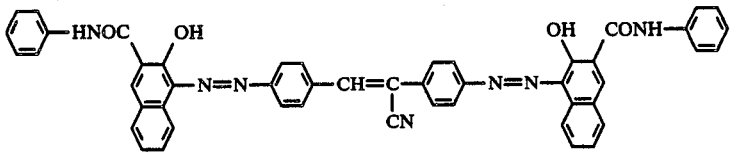
(11) 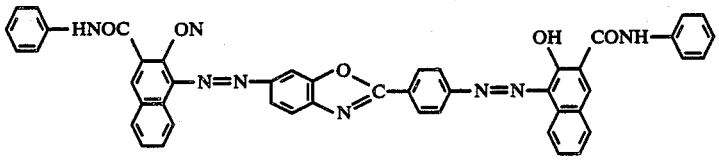
(12) 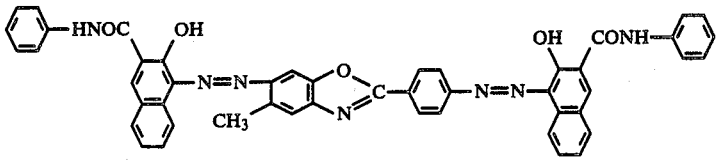
(13) 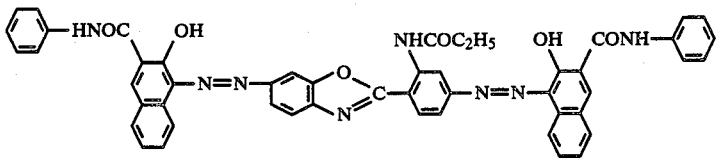
(14) 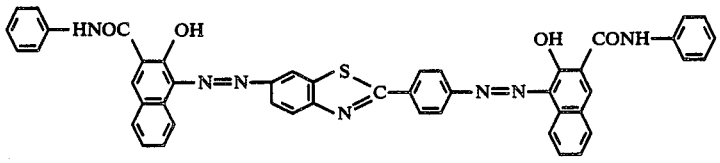
(15) 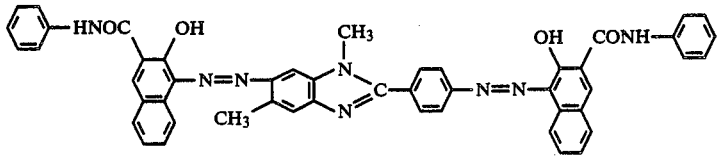
(16) 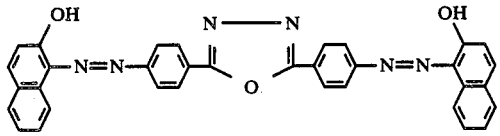
(17) 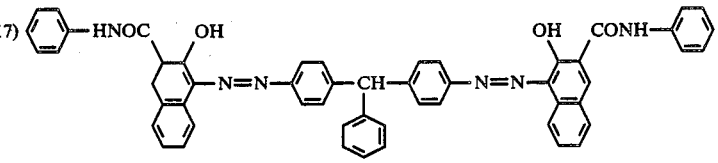

-continued
(18)
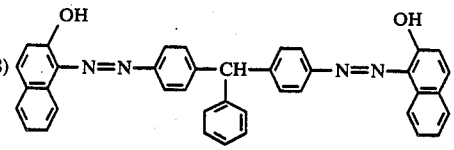
(19)
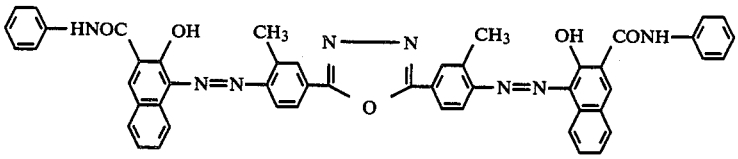
(20)
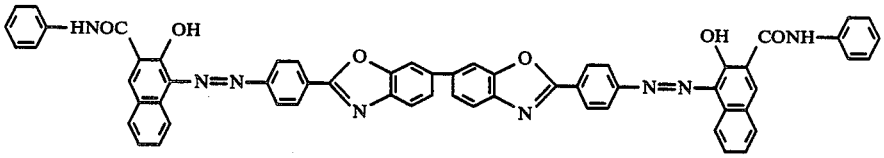
(21)
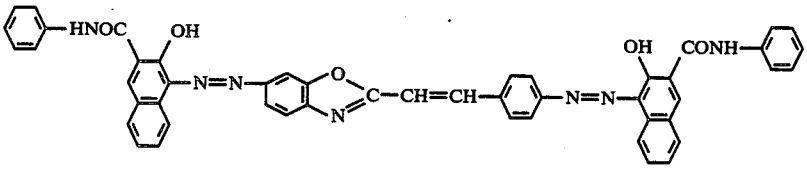
(22)
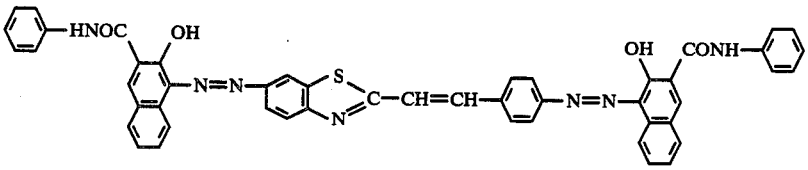
(23)
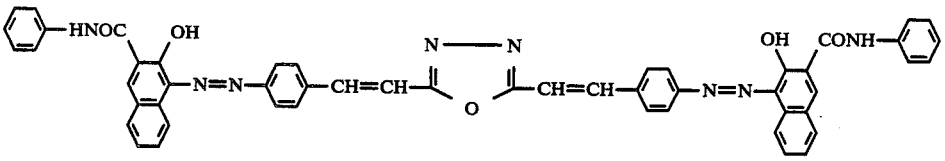
(24)
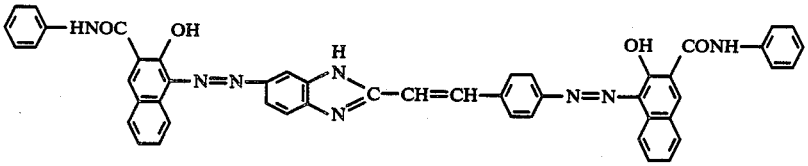
(25)
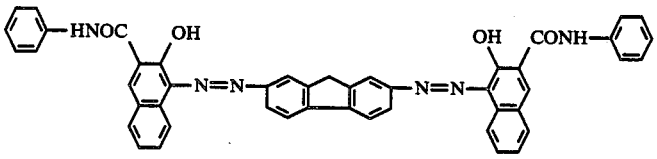
(26)
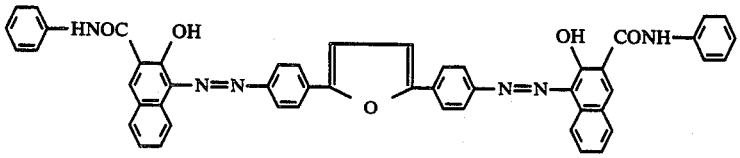

-continued

(27) 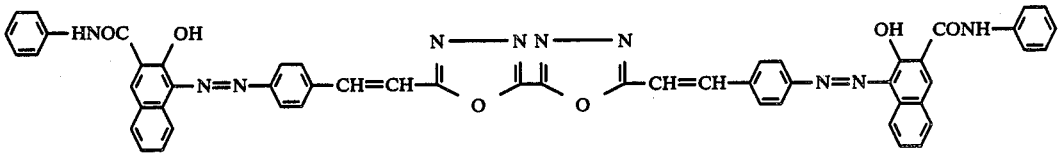

(28) 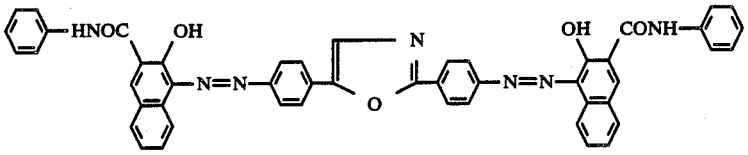

(29) 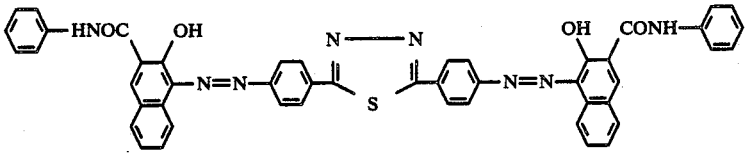

(30) 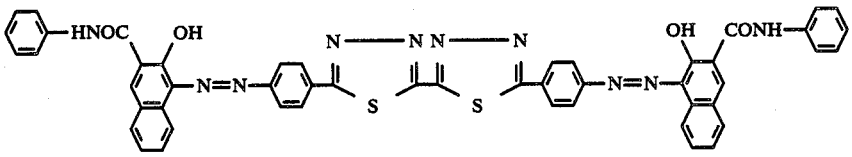

(31) 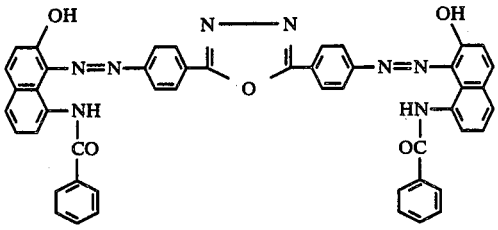

(32) 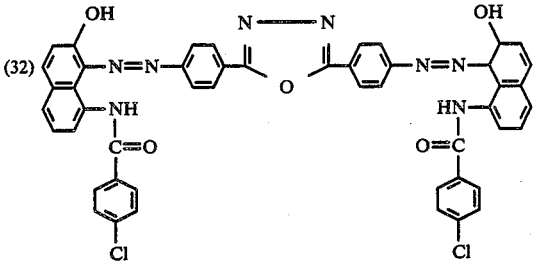

(33) 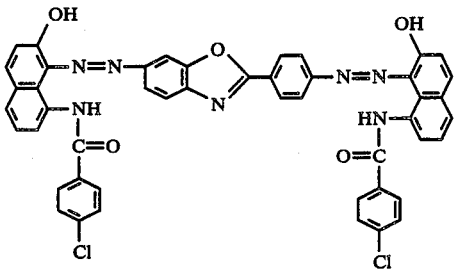

(34) 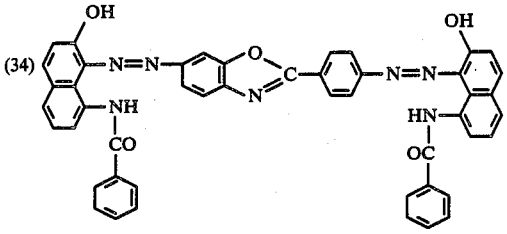

The charge generation layer is desired to contain the above organic photoconductive material (organic charge-generating material) as much as possible for obtaining adequate light absorbance. However, this layer is desirably as thin as up to 5μ, preferably 0.01–1μ, so that the moving distance of the generated charge carriers may remains small. The reasons for these considerations are that most of the incident light is desired to be absorbed in the charge generation layer to generate a great number of charge carriers and that the generated charge carriers are required to be injected into the charge transport layer without being deactivated by recombination or trapping. The charge generation layer is disposed between the charge transport layer and the conductive layer. Alternatively, the charge generation layer may be disposed on the charge transport layer.

The photosensitive layer comprising these charge generation and charge transport layers is laid on a conductive substrate, which has conductivity in itself or comprises an insulating sheet or plate overlaid with a conductive film. Substrates of the former type include aluminum, aluminum alloy, copper, zinc, stainless steel, vanadium, molybdenum, chromium, titanium, nickel, indium, gold, platinum sheets or plates, and the like. Substrates of the latter type include sheets or plates of plastics, for example, polyethylene, polypropylene, poly(vinyl chloride), poly(ethylene terephthalate), acrylic resin, and polyfluoroethylene, overlaid with (1) a film of aluminum, aluminum alloy, indium oxide, tin oxide, indium oxide-tin oxide alloy, or the like formed by vapour deposition or (2) a coating of conductive particles (e.g. carbon black or silver metal particles) mixed with a suitable binder. It is also possible to use, as the substrate, plastic sheets or plates or paper impregnates with conductive particles, or sheets or plates of conductive polymer.

An undercoat functioning as a barrier and adhesive can be laid between the conductive substrate and the photosensitive layer. The undercoat can be formed from casein, poly(vinyl alcohol), nitrocellulose, ethylene-acrylic acid copolymer, polyamide (nylon 6, nylon 66, nylon 610, copolymerized nylon, alkoxymethylated nylon, or the like), polyurethanes, gelation, aluminum oxide, or the like.

Thickness of the undercoat ranges generally from 0.1 to 5μ, preferably from 0.5 to 3μ.

The electrophotographic process of this invention can be applied not only to electrophotographic copying machines but also over a wide field of electrophotographic systems including laser printers, CRT printers, and electrophotographic printing plate making systems.

According to this invention, it is possible to prevent various undesirable phenomena which would be caused by placing the electrophotographic photosensitive members under exposure even instantaneously to the light containing ultraviolet rays, in particular by repeated charging and exposing the photosensitive members in a copying machine using an optical system projecting the light containing ultraviolet rays.

This invention will be illustrated in more detail with reference to the following Examples.

EXAMPLE 1

Aluminum sheets were coated with a solution of casein in aqueous ammonia (casein 11.2 g, 28% aqueous ammonia 1 g, water 222 ml) by means of a Meyer bar and were dried to give a coating thickness of 1.0μ.

A dispersion was prepared by adding 5 g of the disazo pigment of the structure

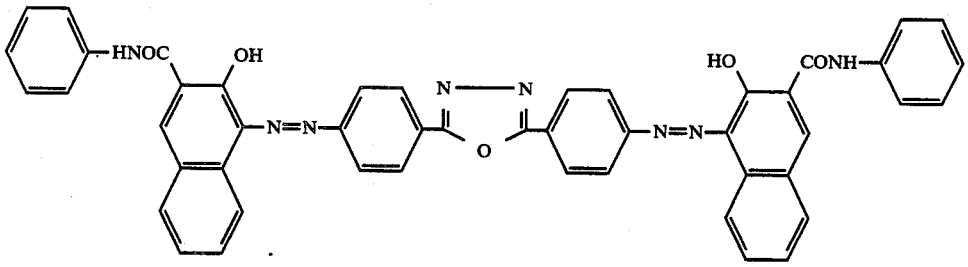

to a solution of 2 g of a butyral resin (degree of butyral conversion 63 mole%) in 95 ml of ethanol, and grinding the mixture in an attritor for 2 hours. The dispersion was applied onto each casein layer by means of a Meyer bar and dried to form a charge generation layer 0.2μ thick.

A solution of 5 g of the hydrazone compound of the structure

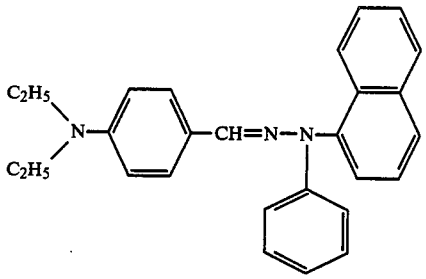

and 5 g of a poly(methyl methacrylate) (number average mol.wt. 100,000) in 70 ml of benzene was then applied onto each charge generation layer by means of a Meyer bar and dried to form a charge transport layer 12μ thick.

Electrophotographic photosensitive members thus prepared were measured for variations in the light area and dark area potentials during repeated use. The measurements were made by using an electrophotographic copying machine provided with a ⊖5.6-KV corona charger, an exposure device having a halogen lamp covered with a yellow filter (sharp cut filter Y-46, mfd. by Hoya Glass Co., Ltd.) for giving an exposure quantity of 15 lux.sec, a developing device, a charger for transferring, a charge-eliminating exposure device having a halogen lamp covered the same yellow filter as the above, and a cleaner. A specimen of the photosensitive members of this Example was attached around the cylinder of the copying machine, which gives a toner image on a tranfer paper with a revolution of the cylinder. The light area potential ($V_L$) and dark area potential ($V_D$) were measured in the initial and 2000th copying cycles. Results thereof are shown in Table 1 together with those of comparative tests made in the same manner as stated above but without using the two yellow filters.

TABLE 1

| Example No. | Initial copying cycle $V_D$ (volt) | Initial copying cycle $V_L$ (volt) | 2000th copying cycle $V_D$ (volt) | 2000th copying cycle $V_L$ (volt) |
|---|---|---|---|---|
| 1 (With filter) | −580 | −50 | −570 | −60 |
| Comparative test (Without filter) | −580 | −40 | −550 | −150 |

EXAMPLE 2

The light area and dark area potentials were measured in the same manner but using ultraviolet absorbing filters (sharp cut filter L-42, mfd. by Hoya Glass Co., Ltd.) in place of the yellow filters. Results thereof are shown in Table 2.

TABLE 2

| Example No. | Initial copying cycle $V_D$ (volt) | Initial copying cycle $V_L$ (volt) | 2000th copying cycle $V_D$ (volt) | 2000th copying cycle $V_L$ (volt) |
|---|---|---|---|---|
| 2 (with ultraviolet absorbing filter) | −580 | −50 | −570 | −70 |

EXAMPLES 3–5

Three kinds of photosensitive members were prepared and tested for the light area and dark area potentials in the same manner as in Example 1 except that N,N-diphenylhydrazino-3-methylidene-9-ethylcarbazole (Example 3), p-diethylaminobenzaldehyde-N,N-diphenylhydrazone (Example 4), and p-pyrrolidinylbenzaldehyde-N,N-diphenylhydrazone (Example 5) were used separately for the preparation of photosensitive members in place of the hydrazone compound used in Example 1. Results thereof are shown in Table 3.

TABLE 3

| Example No. | Initial copying cycle $V_D$ (volt) | Initial copying cycle $V_L$ (volt) | 2000th copying cycle $V_D$ (volt) | 2000th copying cycle $V_L$ (volt) |
|---|---|---|---|---|
| 3 | −570 | −45 | −560 | −60 |
| 4 | −560 | −45 | −560 | −50 |
| 5 | −560 | −40 | −540 | −50 |

What is claimed is:

1. An electrophotographic copying machine comprising:

(1) an electrophotographic photosensitive member having a conductive substrate and a photosensitive layer including a charge generation layer and a charge transport layer;

(2) means for charging said electrophotographic photosensitive member;

(3) means for forming a latent image on said electrophotographic photosensitive member by exposing said electrophotographic photosensitive member to light, said latent image forming means including a light source and at least one of an ultraviolet-absorbing filter and a yellow filter disposed in the optical path between said electrophotographic photosensitive member and said light source; and (4) means for developing the latent image formed on said electrophotographic photosensitive member with a developer.

2. An electrophotographic copying machine according to claim 1, wherein said light source is at least one of a halogen lamp, a xenon lamp, and a tungsten lamp.

3. An electrophotographic copying machine according to claim 1, further comprising a convergent optical transmission array, in addition to said filter, in the optical path between said light source and said photosensitive member.

4. An electrophotographic copying machine according to claim 1, wherein said charge transport layer comprises a charge-transporting material and a binder.

5. An electrophotographic copying machine according to claim 4, wherein said charge-transporting material is at least one of an electron attractive substance and a hole-transporting substance.

6. An electrophotographic copying machine according to claim 5, wherein said charge-transporting material is at least one compound selected from the group consisting of chloranil, bromanil, tetracyanoethylene, tetracyanoquinodimethane, 2,4,7-trinitro-9-fluorenone, 2,4,5,7-tetranitro-9-fluorenone, 2,4,7-trinitro-9 dicyanomethylenefluorenone, 2,4,5,7-tetranitroxanthone, and 2,4,8-trinitrothioxanthone, and polymers of these compounds.

7. An electrophotographic copying machine according to claim 5, wherein said charge-transporting material is at least one compound selected from the group consisting of carbazoles, hydrazones, pyrazolines, oxazole compounds, thiazole compounds, triarylmethane compounds, polyarylalkanes, polyvinylcarbazoles, polyvinylpyrenes, polyvinylanthracenes, polyvinylacridines, pyreneformaldehyde resin, and ethylcarbazole-formaldehyde resin.

8. An electrophotographic copying machine according to claim 7, wherein said charge-transporting material is a hydrazone.

9. An electrophotographic copying machine according to claim 7, wherein said charge-transporting material is a pyrazoline.

10. An electrophotographic copying machine according to claim 1, wherein said charge transport layer is 5 to 30$\mu$ in thickness.

11. An electrophotographic copying machine according to claim 1, wherein said charge transport layer of the electrophotographic photosensitive member contains a charge-transporting material and wherein said ultraviolet filter contains the same compound as said material.

12. An electrophotographic copying machine according to claim 1, wherein said charge transport layer of the electrophotographic photosensitive member contains a charge-transporting material and wherein said yellow filter contains the same compound as said material.

13. An electrophotographic copying machine according to claim 1, wherein said ultraviolet-absorbing filter contains at least one compound selected from the group consisting of chloranil, bromanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, and 2,4,8-trinitrothioxanthone, and polymers of these compounds.

14. An electrophotographic copying machine according to claim 1, wherein said ultraviolet-absorbing filter contains at least one compound selected from the group consisting of carbazoles, hydrazones, pyrazolines, oxazole compounds, thiazole compounds, triarylmethane compounds, polyarylalkanes, polyvinylcarbazoles, polyvinylpyrenes, polyvinylanthracenes, polyvinylacridines, pyreneformaldehyde resin, and ethylcarbazole-formaldehyde resin.

15. An electrophotographic copying machine according to claim 1, wherein said yellow filter contains at least one compound selected from the group consisting of chloranil, bromanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, and 2,4,8-trinitrothioxanthone, and polymers of these compounds.

16. An electrophotographic copying machine according to claim 1, wherein said yellow filter contains at least one compound selected from the group consisting of carbazoles, hydrazones, pyrazolines, oxazole compounds, thiazole compounds, triarylmethane compounds, polyarylalkanes, polyvinylcarbazoles, polyvinylpyrenes, polyvinylanthracenes, polyvinylacridines, pyrene-formaldehyde resin, and ethylcarbazole-formaldehyde resin.

17. An electrophotographic copying machine comprising:

(1) an electrophotographic photosensitive member having a conductive substrate and a photosensitive layer including a charge generation layer and a charge transport layer;

(2) means for charging said electrophotographic photosensitive member;

(3) means for forming a latent image on said electrophotographic photosensitive member by exposing said electrophotographic photosensitive member to light, said latent image forming means including a first light source and at least one of an ultraviolet-absorbing filter and a yellow filter disposed in the optical path between said electrophotographic photosensitive member and said first light source;

(4) means for developing the latent image formed on said electrophotographic photosensitive member with a developer;

(5) means for transferring the developed image into a recording medium; and (6) means for eliminating charge on said photosensitive member after said transfer by said transferring means, said means for eliminating charge comprising a second light source and at least one of an ultraviolet-absorbing filter and a yellow filter disposed in the optical path between said second light source and said photosensitive member.

18. An electrophotographic copying machine comprising:

(1) an electrophotographic photosensitive member having a conductive substrate and a photosensitive layer including a charge generation layer and a charge transport layer;

(2) means for charging said electrophotographic photosensitive member;

(3) means for forming a latent image on said electrophotographic photosensitive member, said image forming means comprising a laser beam;

(4) means for developing the latent image formed on said electrophotographic photosensitive member with a developer;

(5) means for transferring the developed image onto a recording medium; and (6) means for eliminating charge on said photosensitive member after said transfer by said transferring means, said means for eliminating charge comprising a light source and at least one of an ultraviolet-absorbing filter and a yellow filter disposed in the optical path between said light source and said photosensitive member.

19. An electrophotographic process comprising the steps of:

(a) charging an electrophotographic photosensitive member comprising a conductive substrate and a photosensitive layer which includes a charge generation layer and a charge transport layer containing a charge-transporting material;

(b) forming a latent image on the electrophotographic photosensitive member by exposing the electrophotographic photosensitive member to light substantially free of rays having the wavelength band which can be absorbed by the charge-transporting material contained in said charge transport layer; and (c) developing the latent image formed on the electrophotographic photosensitive member with a developer.

20. An electrophotographic process according to claim 19, wherein the rays having the wavelength band which can be absorbed by said charge-transporting material are at least one of ultraviolet rays and rays of blue light.

21. An electrophotographic process according to claim 19, wherein the charged electrophotographic photosensitive member is exposed to the light of at least one of a halogen lamp, a xenon lamp, and a tungsten lamp passed through an ultraviolet-absorbing filter to cut off ultraviolet rays.

22. An electrophotographic process according to claim 19, wherein the charged electrophotographic photosensitive member is exposed to the light of at least one of a halogen lamp, a xenon lamp, and a tungsten lamp passed through a yellow filter to cut off light.

23. An electrophotographic process according to claim 19, wherein said charge-transporting material is at least one of an electron attractive substance and a hole-transporting substance.

24. An electrophotographic process according to claim 19, wherein said charge-transporting material is at least one compound selected from the group consisting of chloranil, bromanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, and 2,4,8-trinitrothioxanthone, and polymers of these compounds.

25. An electrophotographic process according to claim 19, wherein said charge-transporting material is at least one compound selected from the group consisting of carbazoles, hydrazones, pyrazolines, oxazole compounds, thiazole compounds, triarylmethane compounds, polyarylalkanes, polyvinylcarbazoles, polyvinylpyrenes, polyvinylanthracenes, polyvinylacridines, pyrene-formaldehyde resin, and ethylcarbazole-formaldehyde resin.

26. An electrophotographic process according to claim 25, wherein said charge-transporting material is a hydrazone.

27. An electrophotographic process according to claim 25, wherein said charge-transporting material is a pyrazoline.

28. An electrophotographic process according to claim 19, wherein said charge transport layer is 5 to 30$\mu$ in thickness.

29. An electrophotographic process according to claim 19, wherein the charged electrophotographic photosensitive member is exposed to a laser-beam.

30. An electrophotographic process comprising at least two repetitions of the steps of:

(a) charging an electrophotographic photosensitive member comprising a conductive substrate and a photosensitive layer which includes a charge generation layer and a charge transport layer containing a charge-transporting material;

(b) forming a latent image on the electrophotographic photosensitive member by exposing the electrophotographic photosensitive member to light substantially free of rays having the wavelength band which can be absorbed by the charge-transporting material contained in said charge transport layer; and (c) developing the latent image formed on the electrophotographic photosensitive member with a developer.

31. An electrophotographic process according to claim 30, wherein the rays having the wavelength band which can be absorbed by said charge-transporting material are at least one of ultraviolet rays and rays of blue light.

32. An electrophotographic process according to claim 30, wherein the charged electrophotographic photosensitive member is exposed to the light of at least one of a halogen lamp, a xenon lamp, and a tungsten lamp passed through an ultraviolet-absorbing filter to cut off ultraviolet rays.

33. An electrophotographic process according to claim 30, wherein the charged photosensitive member is exposed to the light of at least one of a halogen lamp, a xenon lamp, and a tungsten lamp passed through a yellow filter to cut off blue light.

34. An electrophotographic process according to claim 30, wherein said charge-transporting material is at least one of an electron attactive substance and a hole-transporting substance.

35. An electrophotographic process according to claim 30, wherein said charge-transporting material is at least one compound selected from the group consisting of chloranil, bromanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, and 2,4,8-trinitrothioxanthone, and polymers of these compounds.

36. An electrophotographic process according to claim 30, wherein said charge-transporting material is at least one compound selected from the group consisting of carbazoles, hydrazones, pyrazolines, oxazole compounds, thiazole compounds, triarylmethane compounds, polyarylalkanes, polyvinylcarbazoles, polyvinylpyrenes, polyvinylanthracenes, polyvinylacridines, pyrene-formaldhyde resin, and ethylcarbazole-formaldehyde resin.

37. An electrophotographic process according to claim 30, wherein said charge-transporting material is a hydrazone.

38. An electrophotographic process according to claim 30, wherein said charge-transporting material is a pyrazoline.

39. An electrophotographic process according to claim 30, wherein said charge transport layer is 5 to 30$\mu$ in thickness.

40. An electrophotographic process according to claim 30, wherein the charged electrophotographic photosensitive member is exposed to a laser-beam.

41. An electrophotographic process comprising the steps of:

(a) charging an electrophotographic photosensitive member comprising a conductive substrate and a photosensitive layer which includes a charge generation layer and a charge transport layer containing a charge-transporting material;

(b) forming a latent image on the electrophotographic photosensitive member by exposing the electrophotographic photosensitive member to light substantially free of rays having the wavelength band which can be absorbed by the charge-transporting material contained in said charge transport layer;

(c) developing the latent image formed on the electrophotographic photosensitive member with a developer;

(d) a transferring the developed image onto a recording medium; and (e) thereafter eliminating charge from the electrophotographic photosensitive member by exposing it to light substantially free of rays having wavelength band which can be absorbed by said charge-transporting material contained in said charge transport layer.

42. An electrophotographic process comprising the steps of:

(a) charging an electrophotographic photosensitive member comprising a conductive substrate and a photosensitive layer which includes a charge generation layer and a charge transport layer containing a charge-transporting material;

(b) forming a latent image on the electrophotographic photosensitive member by exposing the electrophotographic photosensitive member to a laser-beam;

(c) developing the latent image formed on the electrophotographic photosensitive member with a developer;

(d) transferring the developed image onto a recording medium; and (e) thereafter eliminating charge from the electrophotographic photosensitive member by exposing it to light substantially free of rays having the wavelength band which can be absorbed by said charge-transporting material contained in said charge transport layer.

43. An electrophotographic process according to claim 42, wherein said laser beam is at least one of a helium-cadmium laser, an argon laser, and a semiconductor laser.

44. An electrophotographic process comprising at least two repetitions of the steps of:

(a) charging an electrophotographic photosensitive member comprising a conductive substrate and a photosensitive layer which includes a charge generation layer and a charge transport layer containing a charge-transporting material;

(b) forming a latent image on the electrophotographic photosensitive member by exposing the electrophotographic photosensitive member to light substantially free of rays having the wavelength band which can be absorbed by the charge-transporting material contained in said charge transport layer;

(c) developing the latent image formed on the electrophotographic photosensitive member with a developer;

(d) transferring the developed image onto a recording medium; and (e) thereafter eliminating charge from the electrophotographic photosensitive member by exposing it to light substantially free of rays having the wavelength band which can be absorbed by said charge-transporting material contained in said charge transport layer.

45. An electrophotographic process comprising at least two repetitions of the steps of:

(a) charging an electrophotographic photosensitive member comprising a conductive substrate and a photosensitive layer which includes a charge generation layer and a charge transport layer containing a charge-transporting material;

(b) forming a latent image on the electrophotographic photosensitive member by exposing the electrophotographic photosensitive member to a laser-beam;

(c) developing the latent image formed on the electrophotographic photosensitive member with a developer;

(d) transferring the developed image onto a recording medium, and (e) thereafter eliminating charge from the electrophotographic photosensitive member by exposing it to light substantially free of rays having the wavelength band which can be absorbed by said charge-transporting material contained in said charge transport layer.

46. An electrophotographic process comprising the steps of:

(a) charging an electrophotographic photosensitive member comprising a conductive substrate and a photosensitive layer which includes a charge generation layer and a charge transport layer containing a charge-transporting material;

(b) forming a latent image on the electrophotographic photosensitive member by exposing the electrophotographic photosensitive member to light;

(c) developing the latent image formed on the electrophotographic photosensitive member with a developer;

(d) transferring the developed image onto a recording medium; and (e) thereafter eliminating charge from the electrophotographic photosensitive member by exposing it to light substantially free of rays having the wavelength band which can be absorbed by the charge-transporting material contained in said charge transport layer.

47. An electrophotographic process comprising at least two repetitions of the steps of:

(a) charging an electrophotographic photosensitive member comprising a conductive substrate and a photosensitive layer which includes a charge generation layer and a charge transport layer containing a charge-transporting material;

(b) forming a latent image on the electrophotographic photosensitive member by exposing the electrophotographic photosensitive member to light;

(c) developing the latent image formed on the electrophotographic photosensitive member with a developer;

(d) transferring the developed image onto a recording paper medium; and (e) thereafter eliminating charge from the electrophotographic photosensitive member by exposing it to light substantially free of rays having the wavelength band which may be absorbed by the charge-transporting material contained in said charge transport layer.

* * * * *

UNITED STATES PATENT AND TRADEMARK OFFICE

CERTIFICATE OF CORRECTION

PATENT NO. : 4,533,232

DATED : August 6, 1985

INVENTOR(S) : NAOTO FUJIMURA, ET AL.

It is certified that error appears in the above-identified patent and that said Letters Patent is hereby corrected as shown below:

Column 1, line 62, change "tends to gradually to result in" to --tends to gradually result in--.

Column 2, line 8, change "in inhibited" to --is inhibited--;
line 14, change "of; (a)" to --of: (a)--; and
line 55, change "charge eliminating" to --charge-eliminating--.

Column 3, line 57, change "in sereis" to --in series--.

Column 4, line 41, change "Hole-transporting substance:" to --Hole-transporting substances:--.

Column 6, line 21, change "selinium-tellulium" to --selinium-tellurium--; and
line 32, change "(2) Selenium-tellulium" to --(2) Selinium-tellurium--.

Column 7, No. 11, change " 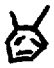 ON" to -- 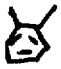 OH--.

Column 11, line 57, change "may remains" to --may remain--.

Column 14, line 29, change "covered the" to --covered with the--; and
line 33, change "transferpaper" to --transfer paper--.

UNITED STATES PATENT AND TRADEMARK OFFICE

CERTIFICATE OF CORRECTION

PATENT NO. : 4,533,232

DATED : August 6, 1985

INVENTOR(S) : NAOTO FUJIMURA, ET AL.

It is certified that error appears in the above-identified patent and that said Letters Patent is hereby corrected as shown below:

Column 17, line 27, change "image into" to --image onto--.

Column 18, line 23, change "off light." to --off blue light.--.

Column 20, line 6, change "(d) a transferring" to --(d) transferring--; and
line 10, change "having wavelength" to --having a wavelength--.

Column 21, line 11, change "medium, and" to --medium; and--.

Signed and Sealed this

*Twelfth* Day of *August 1986*

[SEAL]

*Attest:*

DONALD J. QUIGG

*Attesting Officer*

*Commissioner of Patents and Trademarks*